US010934705B2

(12) United States Patent
Weber

(10) Patent No.: US 10,934,705 B2
(45) Date of Patent: Mar. 2, 2021

(54) WALL CONSTRUCTION MEMBERS AND SYSTEM

(71) Applicant: Mark R. Weber, Chicago, IL (US)

(72) Inventor: Mark R. Weber, Chicago, IL (US)

(73) Assignee: MAX-BLOCK DEVELOPMENT L.L.C., Chicago, IL (US)

( * ) Notice: Subject to any disclaimer, the term of this patent is extended or adjusted under 35 U.S.C. 154(b) by 27 days.

(21) Appl. No.: 16/197,120

(22) Filed: Nov. 20, 2018

(65) Prior Publication Data

US 2020/0157802 A1 May 21, 2020

(51) Int. Cl.

| | |
|---|---|
| ***E04B 2/18*** | (2006.01) |
| ***E04B 2/20*** | (2006.01) |
| ***E04B 1/04*** | (2006.01) |
| ***E04F 21/18*** | (2006.01) |
| ***E04B 2/02*** | (2006.01) |

(52) U.S. Cl.

CPC ..... *E04B 2/18* (2013.01); *E04B 1/04* (2013.01); *E04B 2/20* (2013.01); *E04F 21/1877* (2013.01); *E04B 2002/023* (2013.01)

(58) Field of Classification Search

CPC ... E04B 1/043; E04B 2/16; E04B 2/18; E04B 2/20; E04B 2002/023; E04B 2002/0243; E04B 2002/0245; E04B 2002/0247; E04F 21/1877

See application file for complete search history.

(56) References Cited

U.S. PATENT DOCUMENTS 559,663 A 5/1896 Bennet
811,534 A * 2/1906 Akers et al. ..... E04B 2/18 52/286

(Continued)

FOREIGN PATENT DOCUMENTS

DE 2551507 A1 * 5/1977 ..... E04B 2/18
EP 0166249 1/1986

(Continued)

OTHER PUBLICATIONS

International Search Report and Written Opinion dated Apr. 7, 2020, in connection with International Application No. PCT/US2019/062236 (21 pages).

(Continued)

*Primary Examiner* — Christine T Cajilig
(74) *Attorney, Agent, or Firm* — McCracken & Gillen LLC

(57) ABSTRACT

A wall construction system includes multiple block types that interfit with one another to form walls in a staggered arrangement. Block types include jamb blocks having front and back surfaces, a planar surface on a first end, and a second side having a projecting surface or a receiving surface configured to mate with the projecting surface. The jamb block includes a top mating surface and a bottom mating surface configured to mate with the top mating surface. Webs extend from the front surface to the back surface to form voids. A multi-directional elevation is formed over a void adjacent the planar surface to permit stacking of blocks in two orientations. Other block types include a half jamb block having a web to form a void and a planar surface, and a web stretcher having a projecting surface on one end and a receiving surface on another end.

27 Claims, 14 Drawing Sheets

(56) References Cited

U.S. PATENT DOCUMENTS

| | | | | |
|---|---|---|---|---|
| 1,968,393 | A | 7/1934 | Henderson | |
| 2,179,407 | A | 11/1939 | Flores | |
| 3,430,403 | A * | 3/1969 | Muse | E04B 2/18 52/437 |
| 3,780,484 | A | 12/1973 | Muse | |
| 3,885,361 | A | 5/1975 | De Schutter | |
| 4,107,894 | A | 8/1978 | Mullins | |
| 4,123,881 | A | 11/1978 | Muse | |
| 4,182,089 | A | 1/1980 | Cook | |
| 4,186,540 | A * | 2/1980 | Mullins | E04B 2/18 52/592.6 |
| 4,324,080 | A | 4/1982 | Mullins | |
| 4,426,815 | A * | 1/1984 | Brown | A63H 33/088 52/100 |
| 4,429,506 | A | 2/1984 | Henderson | |
| 4,514,949 | A | 5/1985 | Crespo | |
| 5,024,035 | A * | 6/1991 | Hanson | E04B 2/18 52/309.12 |
| 5,575,128 | A | 11/1996 | Haener | |
| 5,711,129 | A | 1/1998 | Woolford | |
| 5,715,635 | A | 2/1998 | Sherwood | |
| 5,802,792 | A | 9/1998 | Fielding et al. | |
| 5,850,718 | A | 12/1998 | MacKarvich | |
| 5,881,524 | A | 3/1999 | Ellison, Jr. | |
| 5,934,037 | A | 8/1999 | Bundra | |
| 5,983,585 | A | 11/1999 | Spakousky | |
| 6,001,050 | A | 12/1999 | Delf | |
| 6,065,265 | A | 5/2000 | Stenekes | |
| 6,138,426 | A | 10/2000 | Mork et al. | |
| D439,678 | S | 3/2001 | Blomquist et al. | |
| 6,226,951 | B1 | 5/2001 | Azar | |
| 6,464,432 | B1 | 10/2002 | Shaw | |
| 6,488,448 | B1 | 12/2002 | Blomquist et al. | |
| 6,568,723 | B2 | 5/2003 | Murphy et al. | |
| 6,854,220 | B2 | 2/2005 | Dueck et al. | |
| 6,960,048 | B2 | 11/2005 | Blomquist et al. | |
| 6,990,774 | B2 | 1/2006 | Clapp | |
| 7,174,687 | B2 | 2/2007 | Ferguson | |
| 7,305,803 | B2 * | 12/2007 | Correa | E04B 2/16 52/503 |
| D591,778 | S | 5/2009 | Stephansky et al. | |
| 7,748,192 | B2 | 7/2010 | Ryder | |
| 7,762,033 | B2 | 7/2010 | Scott et al. | |
| 7,946,086 | B2 | 5/2011 | Hammer et al. | |
| 7,946,093 | B1 | 5/2011 | Sturino | |
| 8,074,419 | B1 | 12/2011 | Humphress et al. | |
| 8,082,714 | B2 * | 12/2011 | Burns | E04F 21/0092 33/526 |
| 9,182,133 | B1 | 11/2015 | Weber | |
| 9,834,943 | B1 * | 12/2017 | Kufner | E04F 21/1877 |
| 2004/0020145 | A1 | 2/2004 | Matsufuji | |
| 2004/0163334 | A1 | 8/2004 | Carlson | |
| 2006/0254162 | A1 * | 11/2006 | Workman | B65G 57/005 52/213 |
| 2007/0180940 | A1 | 8/2007 | Mizon et al. | |
| 2007/0245673 | A1 | 10/2007 | Cerrato | |
| 2008/0182488 | A1 | 7/2008 | Frost et al. | |
| 2008/0202051 | A1 | 8/2008 | Roehrig | |
| 2010/0212247 | A1 | 8/2010 | Kohl et al. | |
| 2013/0042559 | A1 * | 2/2013 | Weber | E04B 2/44 52/439 |
| 2013/0152489 | A1 * | 6/2013 | Weber | E04B 2/48 52/126.4 |
| 2015/0368901 | A1 | 12/2015 | Weber | |

FOREIGN PATENT DOCUMENTS

| | | | | |
|---|---|---|---|---|
| FR | 2074669 | A1 * | 10/1971 | E04B 2/18 |
| WO | WO 00/24982 | | 5/2000 | |
| WO | WO 2006086626 | | 8/2006 | |
| WO | WO 2008/033157 | | 3/2008 | |

OTHER PUBLICATIONS

Web page at http://prostackblock.com/page2.html, 1 page, printed Sep. 13, 2011.

Web page at http://prostackblock.com/ProStackGeneralDesignConsiderations.pdf, 1 page, printed Sep. 13, 2011.

Web page at http://haenerblock.com/pdf/2_Block_System.pcif, Haener Block 16-In Open Faced Two Block System, pp. 1-26, printed Sep. 19, 2011.

Web page at http://haenerblock.com/versatile.html, 2 pages, printed Sep. 19, 2011.

Web page at http://azarblock.com/blockopeningtxt.html, 1 page, printed Sep. 23, 2011.

Web page at http://www.azargroup.com/azathlockfiles/017_how_to_build.pdf, How to Build with Azar Mortarless Building Systems, 5 pages, printed Sep. 23, 2011.

Web page at http://azarblock.com/blockgallery/index.html, 1 page, printed Sep. 23, 2011.

Web page at http://azarblock.com/diy/whatisazarblock.html, Azar Block, Why Azar Block System Ideal fo the Do-It-Yourselfers, 1 page, printed Sep. 23, 2011.

* cited by examiner

WALL CONSTRUCTION MEMBERS AND SYSTEM

CROSS REFERENCE TO RELATED APPLICATIONS

U.S. Pat. No. 8,739,490, titled "WALL CONSTRUCTION BLOCK COMBINATION FOR A WALL CONSTRUCTION SYSTEM," is incorporated by reference herein.

REFERENCE REGARDING FEDERALLY SPONSORED RESEARCH OR DEVELOPMENT

Not applicable

SEQUENTIAL LISTING

Not applicable

BACKGROUND OF THE DISCLOSURE

1. Field of the Background

The present invention generally relates to construction materials, and more particularly, to a system for constructing a wall and components thereof.

2. Description of the Background

Typical concrete wall structures are fabricated using concrete masonry units (CMU's—otherwise referred to as concrete blocks) that are positioned in courses atop a foundation and joined to one another by mortar. Ordinary CMU's include planar front and rear faces and, often, two or three spaced webs extending between the front and rear faces. The webs define one or two voids extending fully from top to bottom of the CMU. Outermost webs may comprise planar or recessed end faces of the CMU. The CMU is typically formed from cast concrete or other materials in a standard size.

Building a wall using CMU's is a time-consuming process that is best undertaken by a skilled tradesperson, such as a mason. Once a level foundation has been prepared, the mason must arrange CMU's in level and plumb courses. The process of building is complex because the mason must use mortar both as a positioning and bonding agent. The consistency of the uncured mortar and the strength of the mortar, when dry, have a major impact on the quality and strength of the resulting wall. Positioning accuracy during building must be constantly checked, leading to increased assembly time.

When building walls, CMUs are typically arranged in courses stacked on top of one another. The CMUs are stacked with courses run in a staggered arrangement from one end of the wall to the other. The CMUs come in a variety of forms. The walls may end at a jamb, such as a door jamb, where the last CMU in a course may have to be half the length of the standard CMUs in the rest of the course. The CMUs are typically manufactured in a single form so that CMUs would need to be cut in half to provide for half-length pieces. This cutting step is typically done in the field complicating the process of building the wall.

Some CMUs are made in systems having different forms that permit an inter-fitting relationships with adjacent CMUs. Some CMUs permit an inter-fitting relationship between adjacent CMUs positioned end-to-end and stacked blocks. Such CMUs typically result in the need for a large number of different types of blocks to allow for sufficient stability when forming corners and jambs. Typically, such systems require a starting course of leveling blocks. Different types of blocks are stacked on top of the leveling blocks such as blocks for extending the course, blocks for forming corners, and blocks for forming jambs. The blocks for forming corners are typically different from blocks used to form jambs resulting in a more costly system due to the large number of different types of blocks that are required. Typical multi-form block systems are also complicated to work with and may require skills typical masons may not have.

SUMMARY OF THE DISCLOSURE

According to one aspect, a wall construction member includes a front surface, a back surface, a top side comprising a top side mating surface, a bottom side comprising a bottom side mating surface adapted to mate with the top side mating surface, a first end side having a planar end surface, and a second end side opposite the first end side. The second end side includes one of a projecting end surface or a receiving end surface configured to mate with the projecting end surface. At least one web extending between the front surface and the back surface defines at least one void. A top surface is disposed at the top side and a bottom surface is disposed at the bottom side, wherein the top side mating surface comprises a multi-directional elevation pattern on the top surface adjacent the first end side. The bottom side mating surface comprises a recess pattern including a bottom perimeter surface adjacent bottom portions of the front surface, the back surface, and the first end side, at least one channel inwardly adjacent and defining at least a portion of the bottom perimeter surface and extending upwardly with respect to the bottom perimeter surface, and a web bottom surface of the at least one web disposed adjacent the at least one channel and substantially coplanar with a portion of the bottom perimeter surface. The bottom perimeter surface includes a lower surface of the first end side that extends continuously and fully from the front surface to the back surface. The recess pattern is adapted to mate with the multi-directional elevation pattern in two orientations.

According to another aspect, a wall construction system includes a plurality of blocks configured to interfit in multiple courses disposed in a staggered arrangement to form walls, corners, and wall jambs, the plurality of blocks including a jamb block. The plurality of blocks includes a front surface, a back surface, a top side extending between the front surface and the back surface. The plurality of blocks further includes a top side mating surface, a bottom side opposite the top side having a bottom side mating surface configured to mate with a top side mating surface of another block of the plurality of blocks, a first end side having a planar end surface, and a second end side opposite the first end side. The second end side includes one of a projecting end surface or a receiving end surface configured to mate with a receiving end surface and a projecting end surface, respectively, of another block of the plurality of blocks. The top side mating surface comprises a multi-directional elevation pattern adjacent the first end side configured to mate with a bottom side mating surface of another block of the plurality of blocks. The bottom side mating surface includes a recess pattern having at least one channel inwardly adjacent and defining at least a portion of the bottom perimeter surface and extending upwardly with respect to the bottom perimeter surface. The bottom perimeter surface extends continuously on substantially the same plane along at least the first end side. The bottom side mating surface further includes a web elevation that provides an opposing wall for the channel wherein the recess pattern is adapted to mate with the multi-directional elevation pattern in two orientations.

According to an additional aspect, a wall construction system includes a plurality of blocks each having at least one web and configured to interfit in multiple courses disposed in a staggered arrangement such that substantially all of the webs of the blocks are vertically aligned. The plurality of blocks includes a first plurality of full jamb blocks, a second plurality of half jamb blocks, and a third plurality of stretcher blocks, wherein each block includes a top side mating surface and a bottom side mating surface. In addition, each block of the first plurality of full jamb blocks comprises a multi-directional elevation pattern disposed at the top side mating surface adjacent a planar first end side. The multi- directional elevation pattern is configured to mate with the bottom side mating surface of another block of the plurality of blocks in two orientations. Each block further comprises a second end side opposite the first end side including one of a projecting end surface or a receiving end surface. The bottom side mating surface includes a recess pattern including at least one channel inwardly adjacent and defining at least a portion of the bottom perimeter surface and extending upwardly with respect to the bottom perimeter surface. The bottom perimeter surface extends continuously on substantially the same plane along at least the first end side and the bottom side mating surface further includes a web elevation that provides an opposing wall for the channel. The recess pattern is adapted to mate with the multi-directional elevation pattern in two orientations. Each block of the second plurality of half jamb blocks comprises a unidirectional elevation pattern disposed at the top side mating surface adjacent a planar third end side wherein the unidirectional elevation pattern is configured to mate with the bottom side mating surface of another block of the plurality of blocks and further comprising a fourth side opposite the third side comprising one of a projecting end surface or a receiving end surface. Further, each block of the third plurality of stretcher blocks includes an elevation pattern disposed at the top side mating surface adjacent a fifth end side wherein the elevation pattern is configured to mate with the bottom side mating surface of another block of the plurality of blocks and further comprising a sixth side opposite the fifth side wherein the fifth and sixth end sides comprise a projecting end surface and a receiving end surface, respectively.

According to a further aspect, a wall construction member includes a front surface, a back surface, a top side comprising a top side mating surface, a bottom side comprising a bottom side mating surface adapted to mate with the top side mating surface, a first end side having a planar end surface, and a second end side opposite the first end side. The second end side includes one of a projecting end surface or a receiving end surface configured to mate with the projecting end surface. The wall construction member further includes at least one web extending between the front surface and the back surface to define at least one void and a top surface disposed at the top side and a bottom surface disposed at the bottom side. The top side mating surface comprises a multi-directional elevation pattern on the top surface adjacent the first end side. In addition, the bottom side mating surface comprises a recess pattern including a bottom perimeter portion at a bottom of and extending fully along the front surface, the back surface, and the first end side. A bottommost surface of the bottom perimeter portion is substantially continuously coplanar along the full extent of the bottom perimeter portion. The recess pattern further includes at least one channel inwardly adjacent and defining at least a portion of the bottom perimeter and extending upwardly with respect to the bottommost surface of the bottom perimeter and a web bottom surface of the at least one web disposed adjacent the at least one channel and substantially coplanar with the bottommost surface. The recess pattern is adapted to mate with the multi-directional elevation pattern in two orientations.

The jamb block, half jamb block, and the wall stretcher block have a bottom side mating surface having a recess pattern configured to mate with an elevation pattern on the top side of the blocks. The jamb block elevation pattern includes four posts on corners of the void adjacent the planar end surface to permit the stacking of a block in more than one orientation.

DETAILED DESCRIPTION OF THE DRAWINGS

Figure 1A:
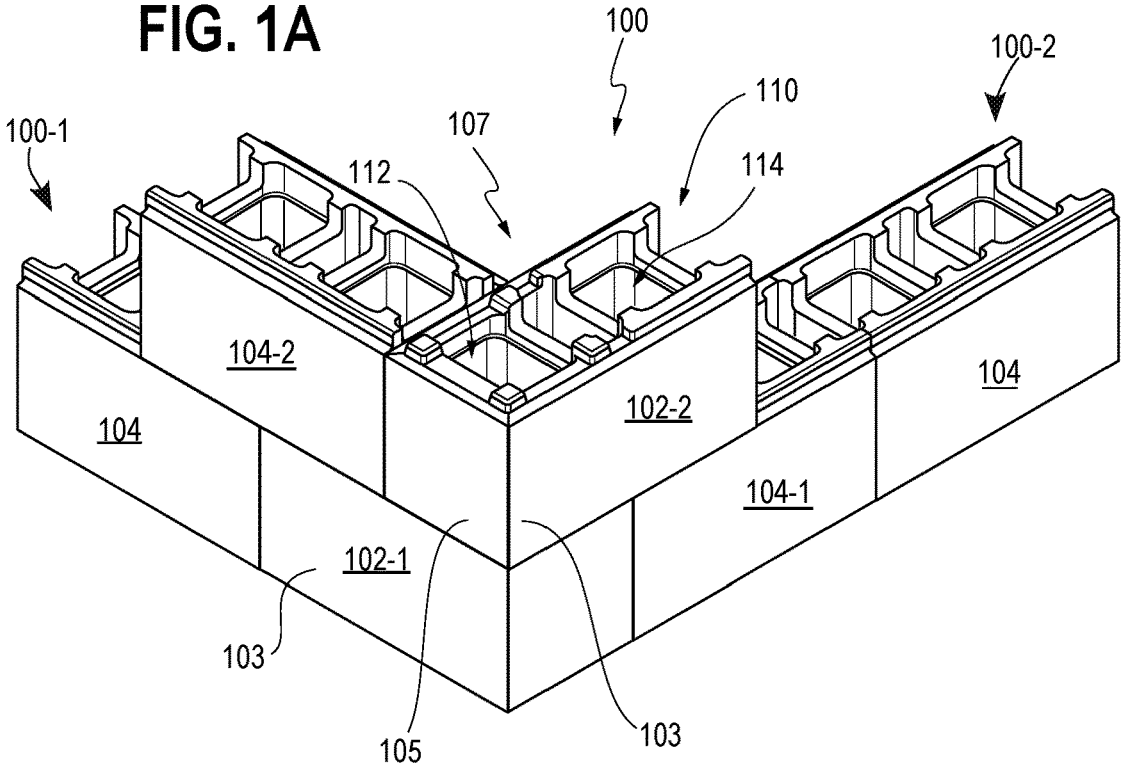
FIGS. 1A and 1B are perspective views of a partially constructed corner built using blocks in an example wall construction system.

As shown in the attached FIGS., a wall construction system comprises a plurality of jamb blocks and/or a plurality of half jamb blocks and/or a plurality of wall stretcher blocks configured to interfit in courses of blocks stacked in a staggered or other arrangement to form a wall or a portion thereof. In the drawings, like reference numerals connote like structures throughout.

Figure 1B:
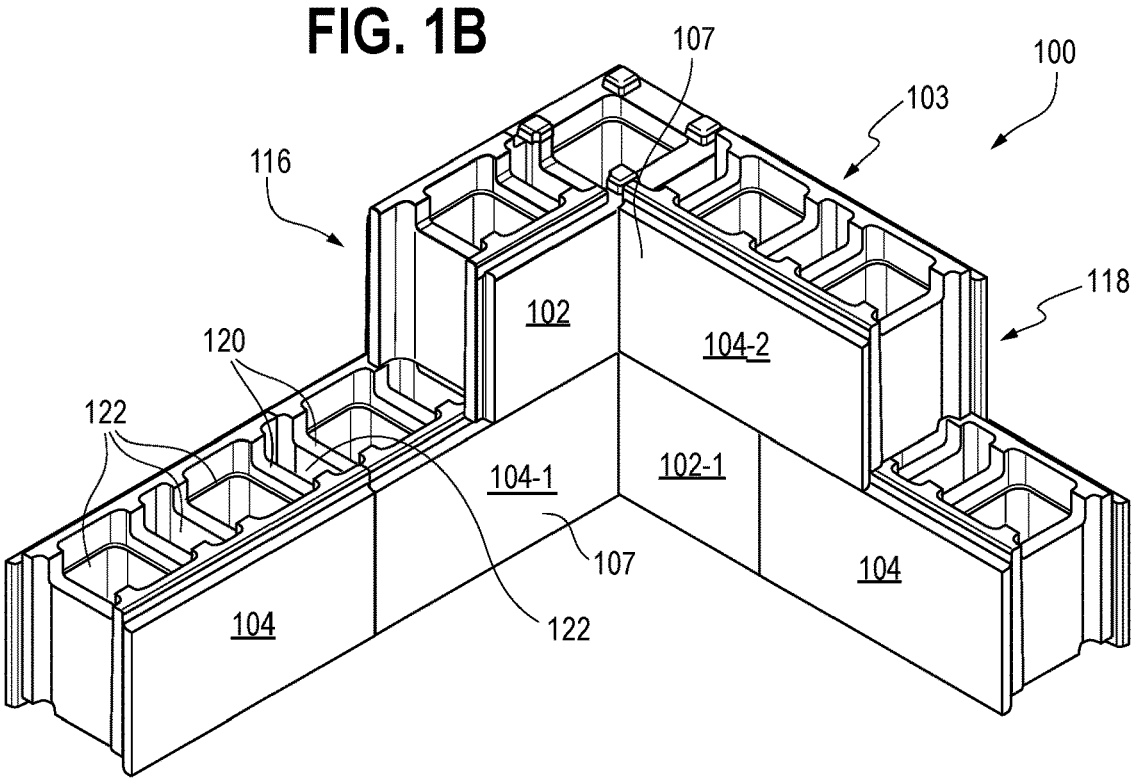
Figure 2A:
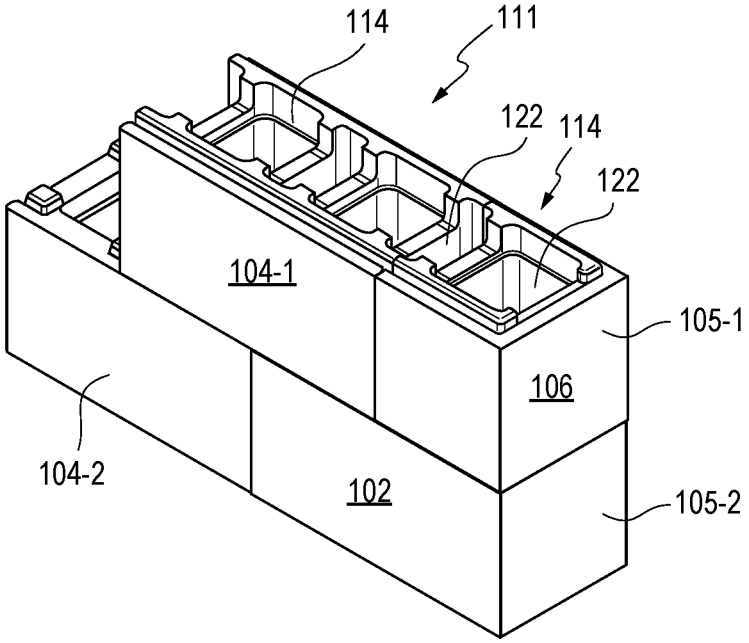
FIGS. 2A and 2B are perspective views of a partially constructed wall at a wall jamb built using blocks in an example wall construction system.
Figure 2B:
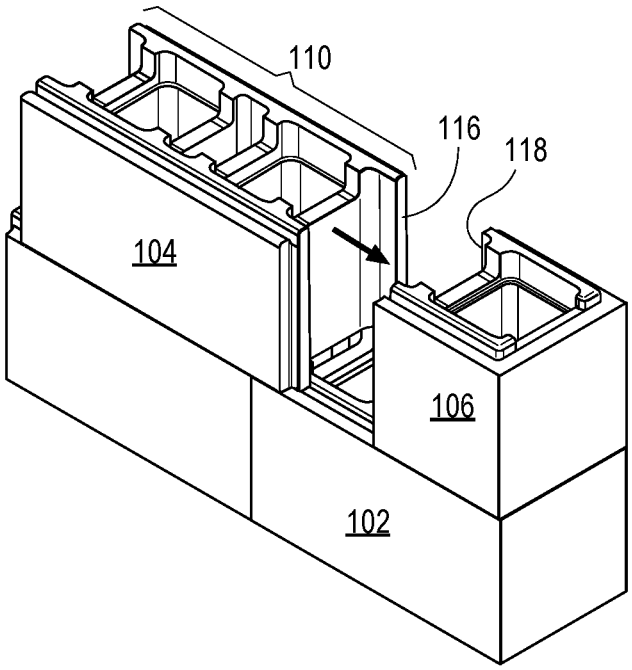

Referring to FIGS. 1A, 1B, 2A, and 2B, portions of a wall comprising a corner 100 (in FIGS. 1A and 1B) and a wall jamb 111 (in FIGS. 2A and 2B) are formed using a wall construction system comprising wall construction members that include a jamb/corner block 102, a wall stretcher block 104 and a half jamb block 106. Each jamb block 102 includes a front surface 103, a first end side having a planar end surface 105, and a back surface 107. The front surface 103 and the back surface 107 comprise opposing planar sides forming opposing faces of the wall along with the other blocks. The planar end surface 105 is on the exposed end of the jamb block opposite a second end side comprising either a projecting end surface 116 or a receiving end surface 118. The receiving end surface 118 is adapted to mate with the projecting end surface 116 of another block. The projecting end surface 116 is adapted to mate with the receiving end surface 118 of another block. It is noted that the jamb block 102 and the half jamb block 106 may have either a projecting end surface 116 or a receiving end surface 118 on the second end side. The wall stretcher block 104 includes the projecting end surface 116 on one end side and the receiving end surface 118 on the opposing end side. FIG. 2B depicts the wall stretcher block 104 with the projecting end surface 116 fitting (indicated by the arrow) into the receiving end surface 118 of the half jamb block 106.

As shown in FIGS. 1A and 1B, the jamb/corner block 102 allows for blocks to be stacked on top in at least two orientations making the jamb/corner block 102 suitable for forming corners. A first course may be started with a first jamb block 102-1 oriented along the direction of one wall 100-1 meeting at the corner 100. A stretcher block 104-1 may be placed in the direction of the other wall 100-2 so that the receiving end surface 118 of the stretcher block 104-1 abuts against the back surface 107 of the first jamb/corner block 102-1. Another stretcher block 104-2 may be stacked on the first jamb/corner block 102-1 in the orientation of the one wall 100-1. The second stretcher block 104-2 mates with one-half of the top of the first jamb/corner block 102-1 in the orientation of the wall 100-1 and abuts one half of the of the back surface 107 of the second jamb/corner block 102-2. By mating with one half of each of the first jamb/corner block 102-1 and the second j amb/corner block 102-2, the second stretcher block 104-2 provides added stability to the corner 100 without having to bond the first jamb/corner block 102-1 to the second jamb/corner block 102-2 (or to a wall stretcher 104 if used). Further stability is provided by adding cementitious material to voids formed in the blocks as described below with reference to FIGS. 11 and 12.

The blocks forming the wall in the example wall construction system are preferably stacked in a staggered arrangement, although this need not be the case inasmuch as the blocks may be stacked in any suitable manner and arrangement. In the illustrated embodiment, each jamb/corner block 102 and wall stretcher block 104 is stacked on one-half of two abutting blocks below. FIG. 2A thus shows a first wall stretcher block 104-1 stacked on one-half of a second stretcher block 104-2 and one-half of the jamb/corner block 102. The half jamb block 106 provides an end to the top course in FIGS. 2A and 2B in which only half a block length is left to reach the end of the course. The half jamb block 106 has a planar end surface 105-1 to maintain the planar surface of the jamb when stacked on the jamb end (with the planar end surface 105-2) of the jamb/corner block 102.

Figure 3A:
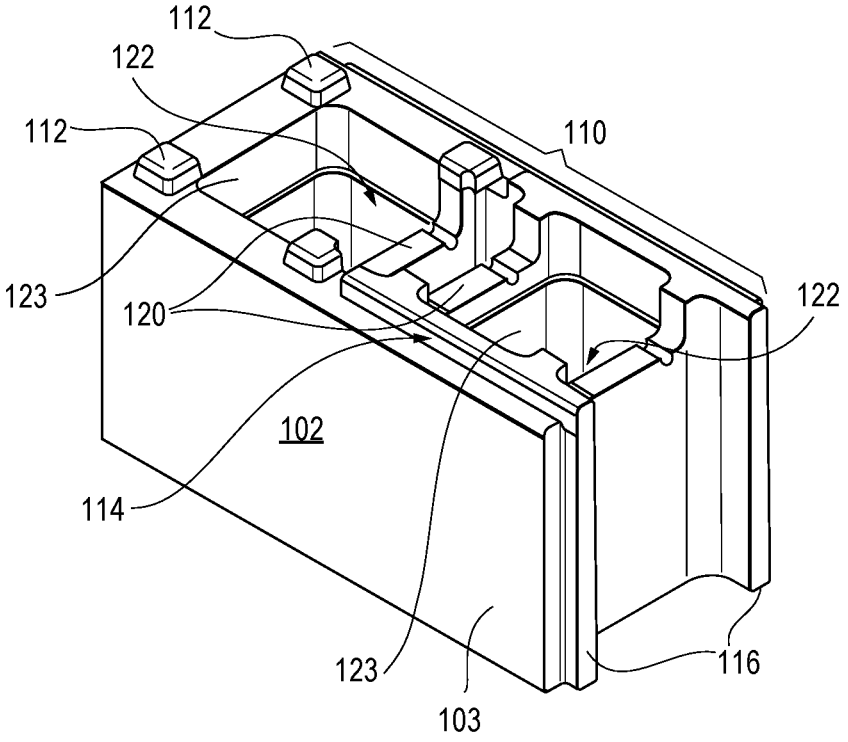
FIGS. 3A and 3B are perspective views of a jamb/corner block.
Figure 3B:
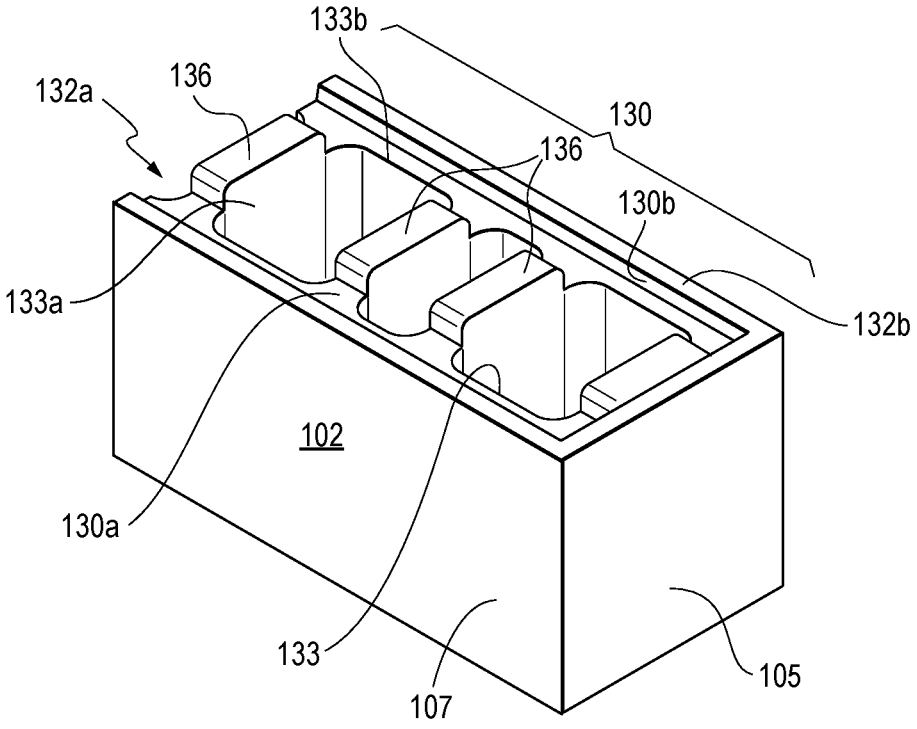
Figure 4:
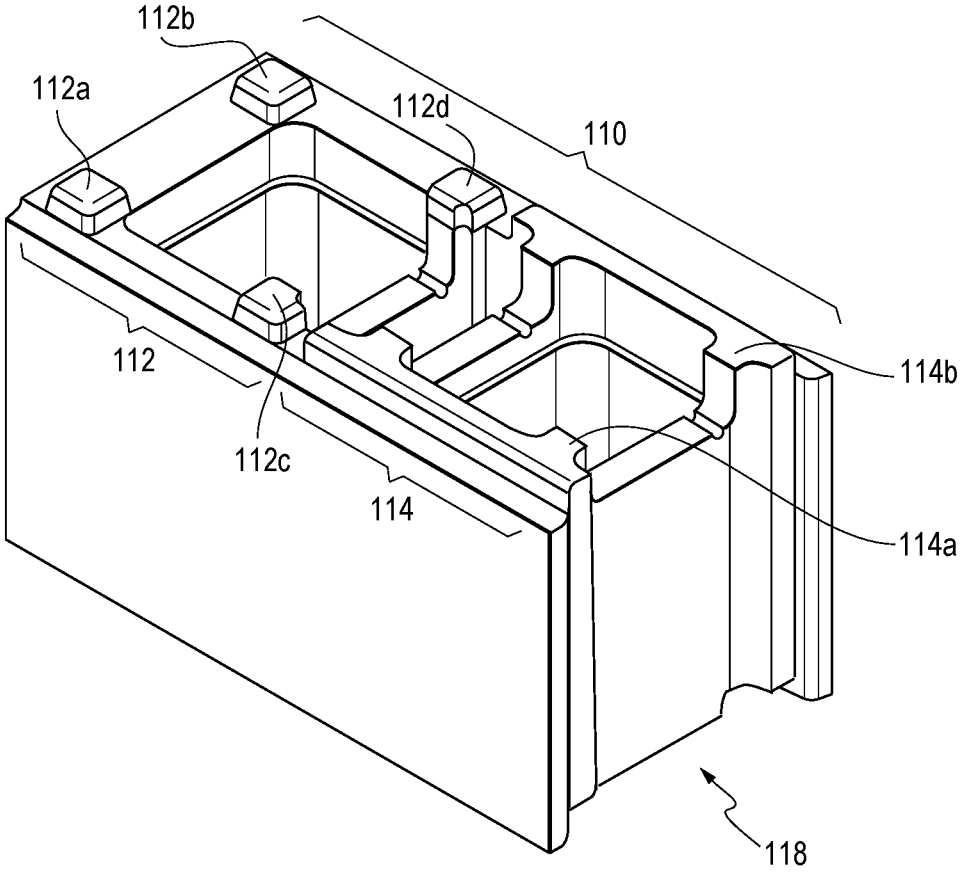
FIG. 4 is a perspective view of a jamb/corner block with a receiving surface.

Referring to FIGS. 3A, 3B, and 4, the jamb/corner block 102 comprises a top side mating surface 110 and a bottom side mating surface 130 configured to mate with the top side mating surface on another block. The jamb/corner block 102 comprises a plurality of webs 120 extending between the front surface 103 and the back surface 107 to define a plurality of voids 122. Each void is defined by a top side perimeter surface 123 on the top side of the jamb/corner block 102 (in FIG. 3A) and a bottom side perimeter surface 133 on the bottom side of the jamb/corner block 102 (in FIG. 3B). The top side mating surface 110 comprises a multi-directional elevation pattern 112 on the top void perimeter surface 123 of the void adjacent the first end side 105 configured to mate with the bottom side mating surface 130 in at least two orientations. The top side mating surface 110 also comprises a unidirectional elevation pattern 114 on the top void perimeter surface 123 of the void adjacent the second end side 116 or 118.

FIGS. 5A-5D illustrate the jamb/corner block 102 in detail. Referring to FIGS. 4 and 5A-5D, the multi-directional elevation pattern 112 on the jamb/corner block 102 comprises four posts 112*a*, 112*b*, 112*c*, and disposed at corners of the rectangular cross-section of the top void perimeter surface 123. The space between the corners in both directions allows for the stacking of another block having a bottom mating surface similar to any of the blocks described herein atop the jamb/corner block 102 in a different orientation than that of the jamb/corner block 102. The unidirectional elevation pattern 114 on the top void perimeter surface 123 of the void 122 adjacent the second end side 116 includes a first wall 114*a* extending from the top void perimeter surface 123 forming a first ledge 150*a* between the first wall 114*a* and the front surface 103, and a second wall 114*b* opposite the first wall 114*a* extending from the top void perimeter surface 123 forming a second ledge 150*b* between the second wall 114*b* and the back surface 107. A third ledge 150*c* is formed between the top side perimeter surface 123 and the planar end surface 105. The first ledge 150*a* and the second ledge 150*b* extend the length of the jamb/corner block 102 to the planar end surface 105. The third ledge extends from the front surface 103 to the back surface 107. The first ledge 150*a*, the second ledge 150*b*, and the third ledge 150*c* have a downward slope to function as a drainage plane that diverts water toward the block exterior.

The void 122 adjacent the projecting end surface 116 is formed by two webs 120-1 and 120-2. A third web 120-3 is disposed between the second web 120-2 and the first end side with the planar end surface 105. The second web 120-2 and third web 120-3 form a cell 124 that is smaller than the voids 122. The cell 124 aligns with a space formed when the projecting end surface 116 of a block stacked on top of the jamb block is mated with the receiving end surface 118 of another block stacked on top of the jamb block, for example, in a staggered arrangement. The cell 124 and the space between blocks aligned above may be used to add vertical reinforcement, such as with reinforcing bars (i.e., rebar). The cell 124 and space may also be filled with cementitious material adding further vertical stability to the wall.

Figure 5B:
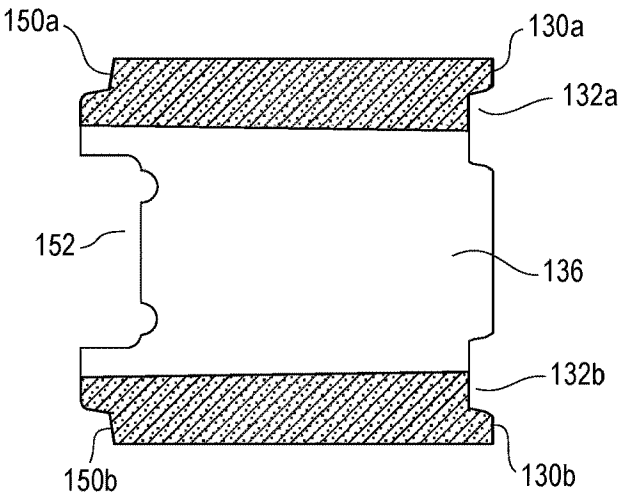
FIGS. 5B and 5C are sectional views taken generally along the lines 5B-5B and 5C-5C, respectively, of FIG. 5A.
Figure 5D:
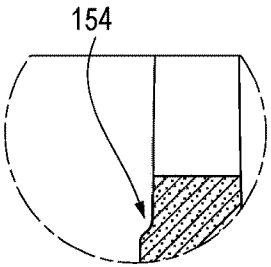
FIG. 5D is an enlarged fragmentary view of a portion of the jamb block taken generally along the view lined 5D-5D of FIG. 5B.
Figure 5A:
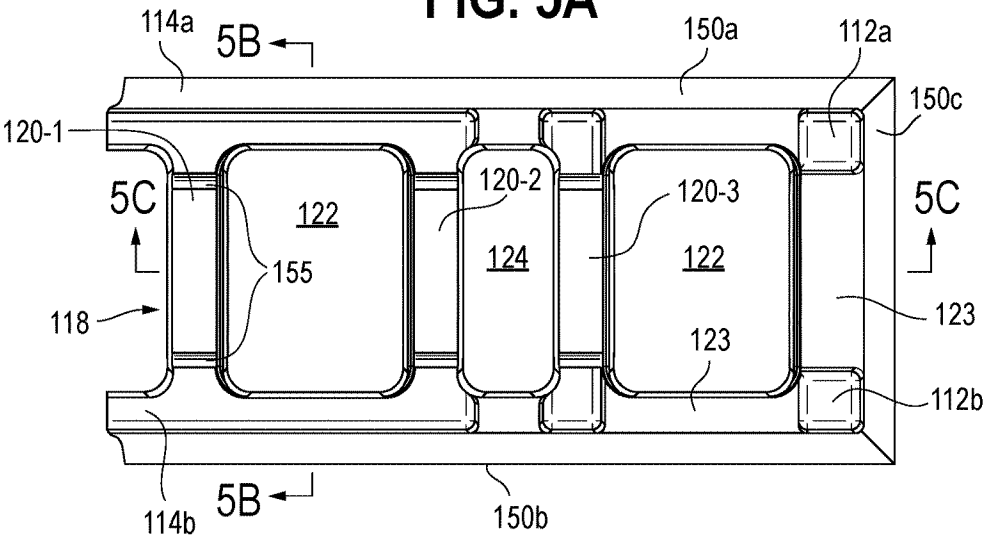
FIG. 5A is a plan view of a jamb/corner block.
Figure 5C:
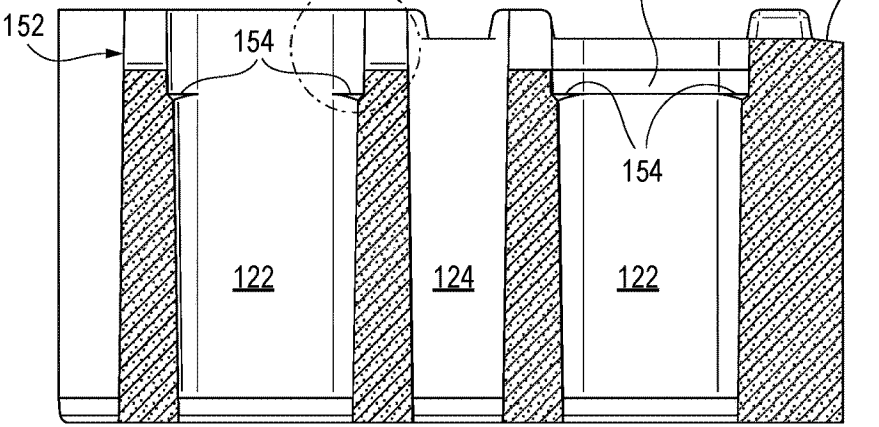

The webs 120 and the inner surface of the front surface and the back surface include a shelf 154 as shown in FIG. 5C. The shelf 154 is configured to support an insert 157 in FIG. 5C. The insert 157 is configured to support a grout plug (not shown in FIGS. 5A-5D, but described in more detail with reference to FIG. 11). When a block, such as a jamb/corner block 102-1, or a wall stretcher block 104, or a half jamb block 106 as shown in FIG. 1B or 2A) is stacked over the jamb/corner block 102-1 in FIG. 1A, for example, the grout plug overlaps the horizontal seam formed between the blocks (See grout plug 320, block 302-1, and block 302-2 in FIG. 11). The grout plugs provide the wall with support against shear forces. The webs of the stacked block (See block 302-1 in FIG. 11) extend into a web recess 152 formed on the web 120 to support the grout plug (See block 302-2 and grout plug 320). The voids 122 may also be used to support the vertical insertion of rebar (See rebar 350 in FIG. 11) as a desired number of courses are stacked during construction of the wall. The web recess 152 also includes a pair of channels 155 on the ends of the web recess 152 sized to support horizontally inserted rebar.

Referring to FIGS. 3B and 5B, the bottom mating surface 130 of the jamb/corner block 102 includes a recess pattern 132 extending length-wise over the bottom void perimeter surface 133. The recess pattern 132 comprises a first channel 132*a* adjacent a first bottom wall 130*a* and forming the bottom void perimeter surface 133*a* on one side, and a second channel 132*b* adjacent a second bottom wall 130*b* and forming the bottom void perimeter surface 133*b* on the other side. The webs 120 include web elevations 136 to provide opposing walls for the channels 132*a*, 132*b* between the voids 122. The recess pattern 132 in the bottom mating surface 130 is formed to mate with either the multi-directional 112 or unidirectional elevation 114 patterns in the top mating surface 110 of another block on which the jamb/corner block 102 is stacked.

Figure 6A:
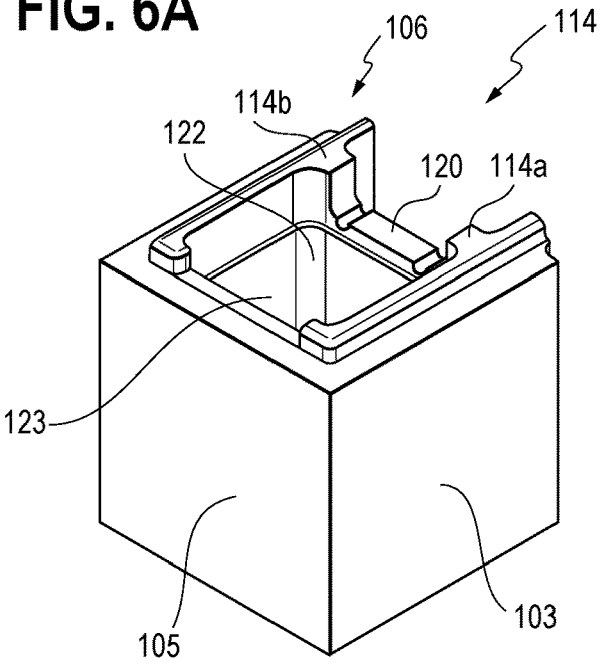
FIGS. 6A and 6B are perspective views of a half jamb block.
Figure 6B:
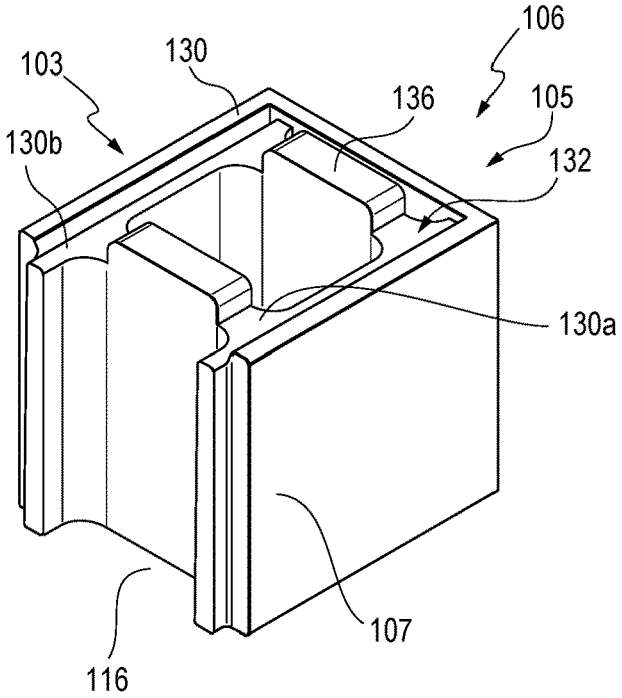

Referring to FIGS. 6A and 6B the half jamb block 106 includes a front surface 103, a back surface 107, a half jamb top side mating surface 110, a half jamb bottom side mating surface 130 configured to mate with the top side mating surface 110 of another block, a planar end surface 105 on a first end side, and either a projecting end surface 116 or a receiving end surface 118 (as shown in FIG. 4 for the jamb block) adapted to receive and mate to the receiving end surface or the projecting end surface, respectively, of another block on a second end side.

The half jamb 106 includes a web 120 extending between the front surface 103 and the back surface 107 to form a void 120 defined by a top void perimeter surface 123 disposed at the top side and a bottom void perimeter surface 133 disposed at the bottom side. The top side mating surface 110 includes a unidirectional elevation pattern 114 formed by a first wall 114*a* and a second wall 114*b* extending from the top void perimeter surface 123 on opposite sides of the void 122. The bottom side mating surface 130 comprises a recess pattern 132 extending length-wise that is the same as, but half as long as the recess pattern 132 described above for the jamb/corner block 102. The similarity of the bottom side mating surface 130 of the half jamb block 106 and the bottom side mating surface 130 of the jamb/corner block 102 allows for the half jamb block 106 to stack on top of the jamb/corner block 102 and vice versa.

Figure 7A:
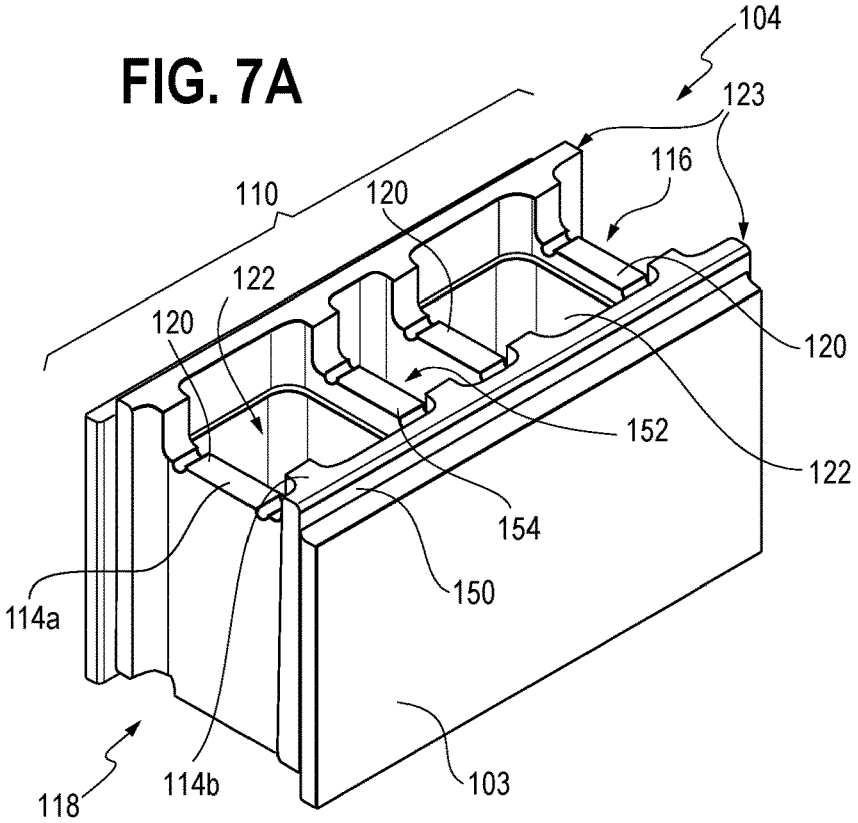
FIGS. 7A and 7B are perspective views of a wall stretcher block.
Figure 7B:
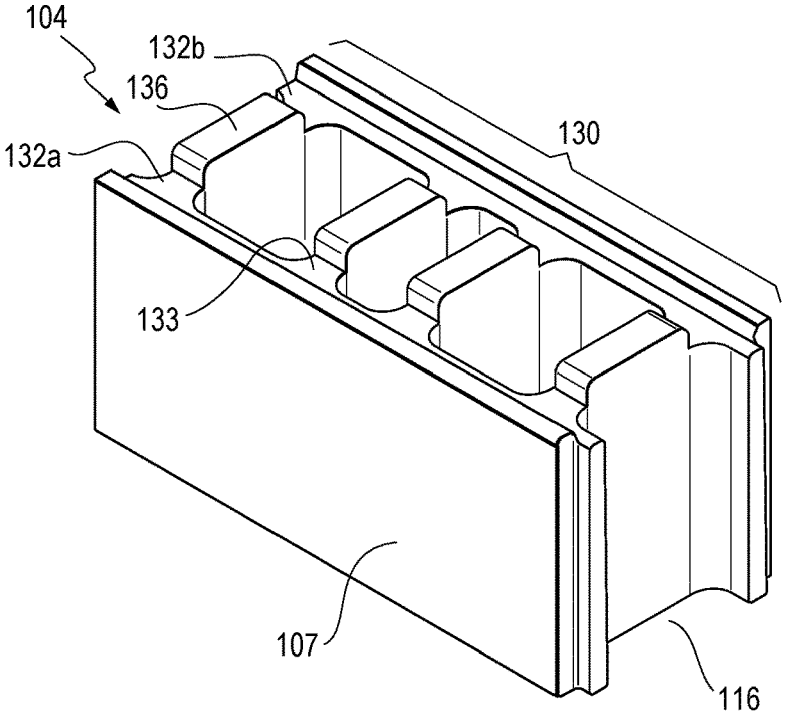

FIGS. 7A and 7B are plan views of the wall stretcher block 104. The wall stretcher block is identical or similar to the blocks 70 and 90 disclosed in U.S. Pat. No. 8,739,490 incorporated by reference herein. The wall stretcher block 104 includes a front surface 103, a back surface 107, a wall stretcher top side mating surface 110, a wall stretcher bottom side mating surface 130 configured to mate with the top side mating surface of another block, a projecting end surface 116 on a first end side, and a receiving end surface 118 on a second end side.

The wall stretcher block 104 includes a plurality of webs 120 extending between the front surface 103 and the back surface 107 to form a plurality of voids 122 defined by a top void perimeter surface 123 disposed at the top side and a bottom void perimeter surface 133 disposed at the bottom side. The top side mating surface 110 includes a unidirectional elevation pattern 114 formed by a first wall 114*a* and a second wall 114*b* extending from the top void perimeter surface 123 on opposite sides of the voids 122. The bottom side mating surface 130 comprises a recess pattern 132 extending length-wise that is the same as the recess pattern 132 described above for the jamb/corner block 102. The similarity of the bottom side mating surface 130 of the wall stretcher block 104 and the bottom side mating surface 130 of the jamb/corner block 102 allows for the wall stretcher block 104 to stack on top of the jamb/corner block 102 or half jamb block 104, and vice versa.

The wall construction system includes a leveling system for ensuring the blocks laid in the courses of the wall are level. A part of the leveling system is the structure of the block types that allow for the use of leveling tools in the form of shims while the wall is in construction. In the illustrated example wall construction systems, each web 120 in the blocks may include a web recess extending across a web top surface and downward sufficient to leave a web gap 152 (FIGS. 11 and 12) between the recessed web top surface and the web elevations 136 when another block is mounted on top of the block. A leveling shim may be inserted in the web gap to enable adjustment of the level of the blocks in one or both of a length-wise direction and a transverse direction. The leveling shim may include a generally wedge-like shape or cam shape. In the former, the shim may include a low-rise front portion that ramps up to a high-rise back portion. An optional handle may extend from the high-rise back portion or another part of the shim. An optional nose portion may be disposed at an end of the shim. The leveling shim is insertable into the web gap 152 to expand the web gap 152 sufficiently to level the block. The leveling process may be undertaken on one or more courses above a first course of blocks wherein the latter are set on a footing or other foundation. While the leveling of the first course of blocks may be undertaken using the leveling shim(s) disclosed herein, the first course may instead be leveled using, for example, the leveling system disclosed in U.S. Pat. No. 8,739,490, incorporated by reference herein. Thereafter, a periodic level check may be performed as the wall is constructed and leveling may be checked and adjusted as the wall is raised.

Figure 8A:
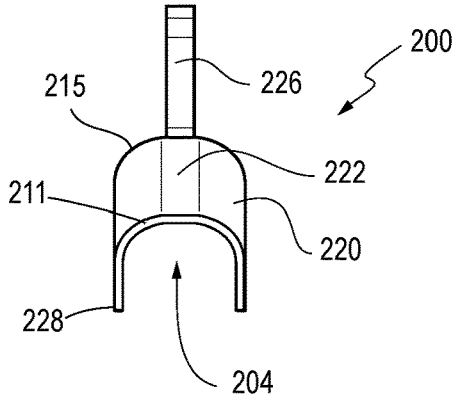
FIGS. 8A, 8B, and 8C are end elevational, plane and side elevational views, respectively, of a narrow leveling tool.
Figure 8B:
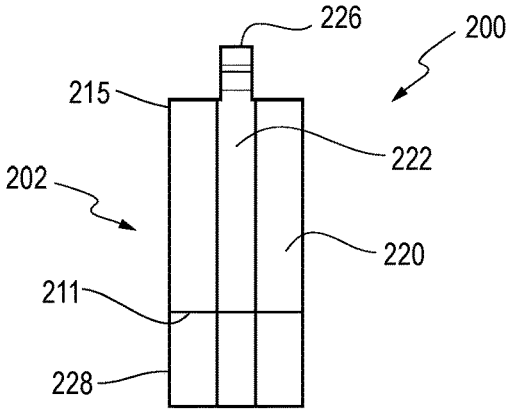
Figure 8C:
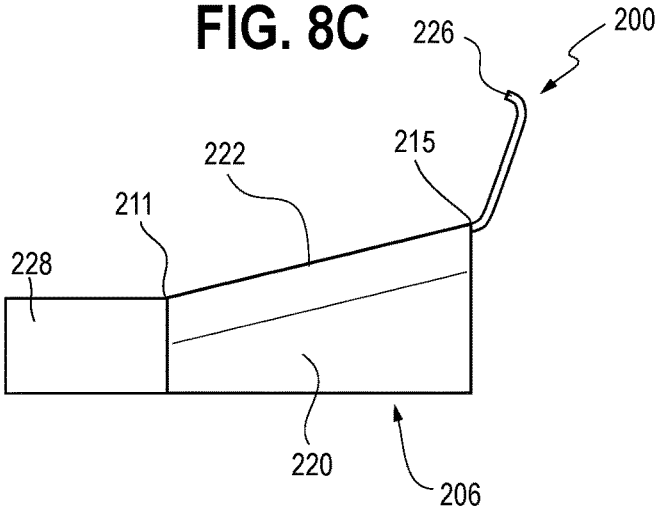

The leveling shims may take a variety of forms, for example, the narrow leveling shim 200 shown in FIGS. 8A-8C. In this example, the narrow leveling shim 200 includes a curved portion 220 with a flattened surface 222 on an arc apex of the curved portion 220. The narrow leveling shim 200 includes an optional shim handle 226 extending from the apex of the curved portion 220. The narrow leveling shim 200 may be made of a stiff material capable of supporting the block weight carried thereby while expanding the web gap, such as steel, aluminum, another metal, wood, plastic, or combinations thereof that is formed in any suitable manner into the desired shape. The narrow leveling shim 200 includes a low rise front portion 211 and a high rise back portion 215 to provide the generally wedge-like shape.

An optional nose portion 228 (best seen in FIGS. 8B and 8C) may be provided at a distal end of the front portion 211. The nose portion 228 may be of any shape that provides a surface for interference with a portion of a lower surface of a block disposed above the shim 200 to prevent significant rotation of the shim 200 during and after installation as noted in greater detail below.

Figure 9A:
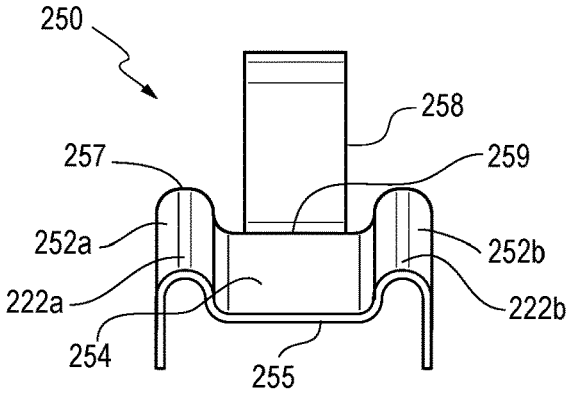
FIGS. 9A, 9B, and 9C are end elevational, plane and side elevational views, respectively, of a wide leveling tool.
Figure 9B:
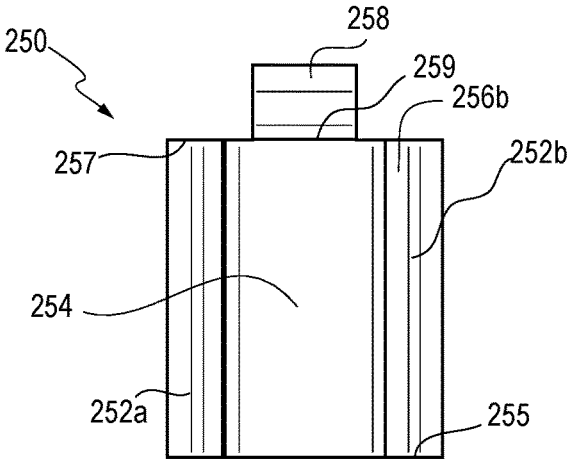
Figure 9C:
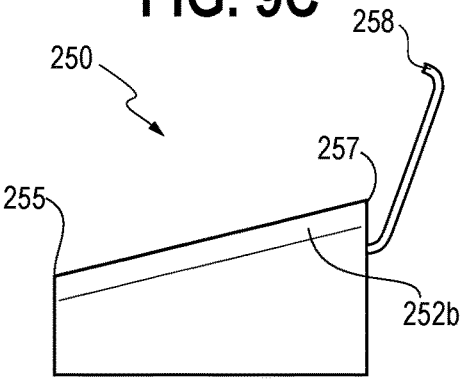

FIGS. 9A-9C depict a wide leveling shim 250. In one example, the wide leveling shim 250 includes spaced curved portions 252*a* and 252*b* with a flattened surface 254 disposed between the arcuate curved portions 252*a*, 252*b*. Each of the curved portions 252*a*, 252*b* includes a flattened surface 222*a*, 222*b* on an apex thereof similar or identical to the flattened surface 222 described above wide leveling shim 250 includes an optional shim handle 258 extending from an end 259 of the surface 254. The wide leveling shim 250 may be made of a stiff material similar or identical to the narrow leveling shim 200 that is formed by machining or otherwise. The wide leveling shim 250 includes a low rise front portion 255 and a high rise back portion 257 to provide the generally wedge-like shape.

During the step of leveling the first course or any other course, one or both of the leveling shims 200, 250 is/are insertable at web gaps at either end or both ends of a first block between such block and a second block disposed vertically below the first block to enable leveling either in a transverse (i.e., front-to-back) or lengthwise direction of the first block. The blocks to be leveled may be any of a jamb/corner block 102, a wall stretcher block 104, and a half jamb block 106.

Figure 10:
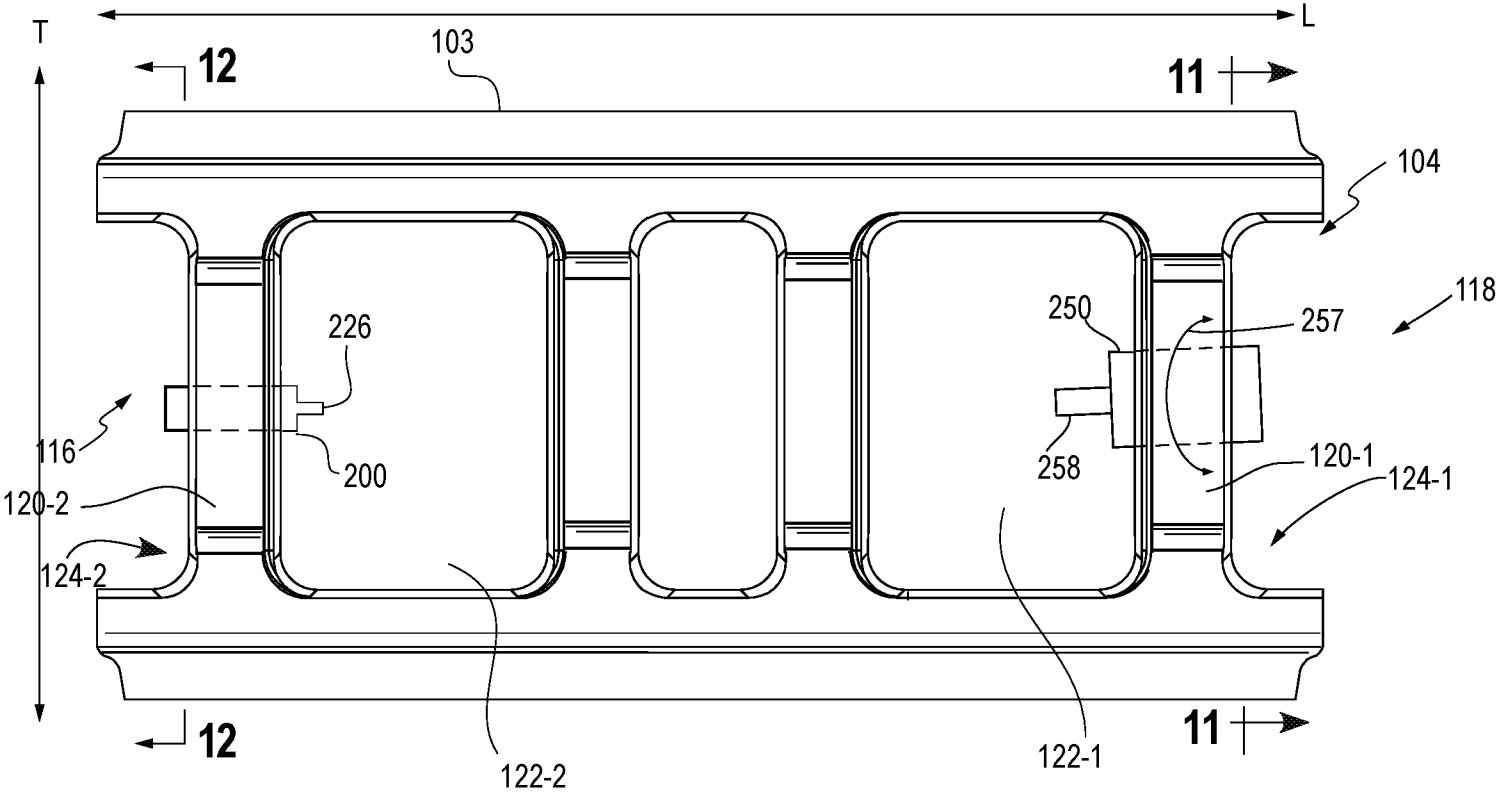
FIG. 10 is a plan view of a jamb block illustrating operation of the leveling tools.
Figure 15:
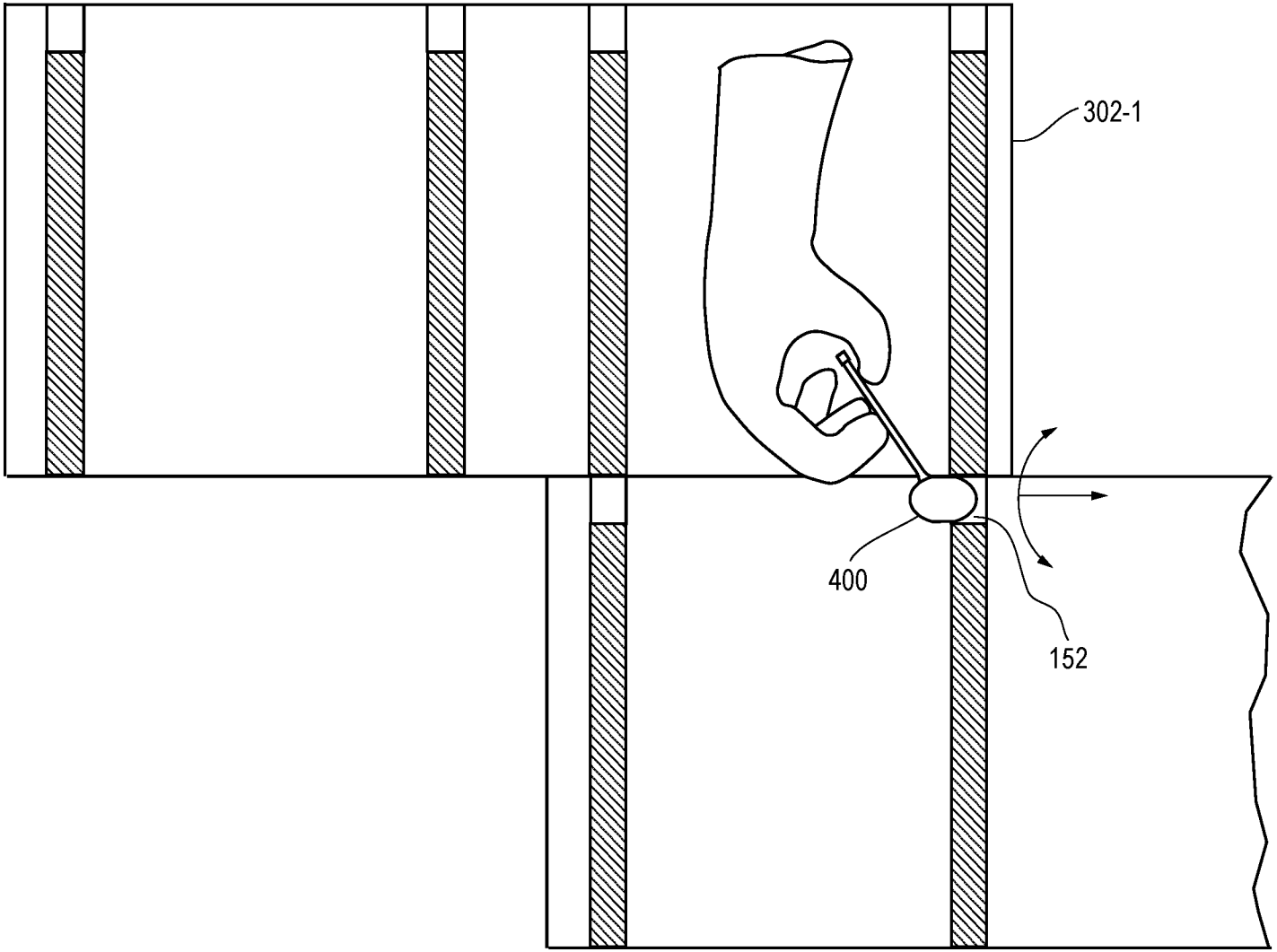
FIG. 15 is a cross sectional view illustrating installation of the shim of FIGS. 13 and 14.

Specifically, FIG. 10 is a top view of a stretcher block 104 having a narrow leveling shim 200 and a wide leveling shim 250 inserted underneath end webs 120-1, 120-2 of the stretcher block 104. The first end web 120-1 is disposed between void 122-1 and a first half cell 124-1. The second web 120-2 is disposed between void 122-2 and a second half cell 124-2. The wide leveling shim 250 is inserted through void 122-1 under the web elevation 136 of the web 120-1 and into the gap 152 (as shown in FIG. 15 in connection with another embodiment) and the narrow leveling shim 200 is inserted through void 122-2 into the gap 152 below the web elevation 136 of the web 120-2 in the same fashion as the wide leveling shim 250. The shims 200 and 250 are positioned to adjust the level in a longitudinal direction L and a transverse direction T of the block 104. For example, a user may check the transverse level by placing a level tool across the top of the stretcher block 104 in the transverse direction T and adjust the level along the transverse direction T by rotating the shims 200 and/or 205 along the direction of the arrows 251*a* and/or 251*b*, respectively, to cause either or both shims to have a height differential in the plane of the web 120-1. This height differential causes the block 104 to tilt along the direction T as required to bring the block 204 into a level condition along such direction. Leveling in the longitudinal direction L is accomplished by inserting either or both shims 200, 250 a greater or lesser extent into the gaps 152 below each web 120-1, 120-2. In any event, the shims 200 and 250 provide three surfaces comprising the surfaces 222 (see FIGS. 8A-8C), and the top surfaces of the portions 252*a*, and 252*b* (see FIGS. 8A-8C) that together support the block 104 in a tripod configuration to keep the block 104 stable during and after leveling. Further, the nose portion 228 of the shim 200 prevents significant rotation of the shim 200 that might otherwise occur as a result of application of the weight of the supported block on the surface 222. The rotation is prevented by interference of the nose portion 228 with an undersurface of the block 104.

The user may also check the level in the longitudinal direction L by placing the level tool across the top of the jamb block 102 in the longitudinal direction L and adjusting the level by adjusting the shim(s) 200 and/or 250 accordingly. For example, the user may push the wide leveling shim 250 into the web gap under the web elevation 136 under the block 104 to raise the side of the block 104 on which the projecting end surface 116 is disposed relative to the side on which the planar end surface 105 is disposed. The optional shim handle 258 may be used to assist the user in pushing the shims 200 into the web gap to leverage the ramp on the wedge-like shim against the block 104.

Additional shims 200, 250 may be inserted below other blocks in the fashion noted above to accomplish leveling of an entire course or courses of blocks. Also, it may be desirable, particularly when the shim 200 and/or 250 is made of wood or other compressible material, to form the shims 200 and/or 250 into solid shapes rather than hollow as illustrated in the FIGS. Particularly in the case of the shim 250 (but not limited necessarily to such shim) it may be preferable to form the bottom of the shim with a dado or other channel to remove a limited thickness from the bottom of the shim while retaining side projections that extend downwardly so that two surfaces are provided for support on the lower block.

Figure 11:
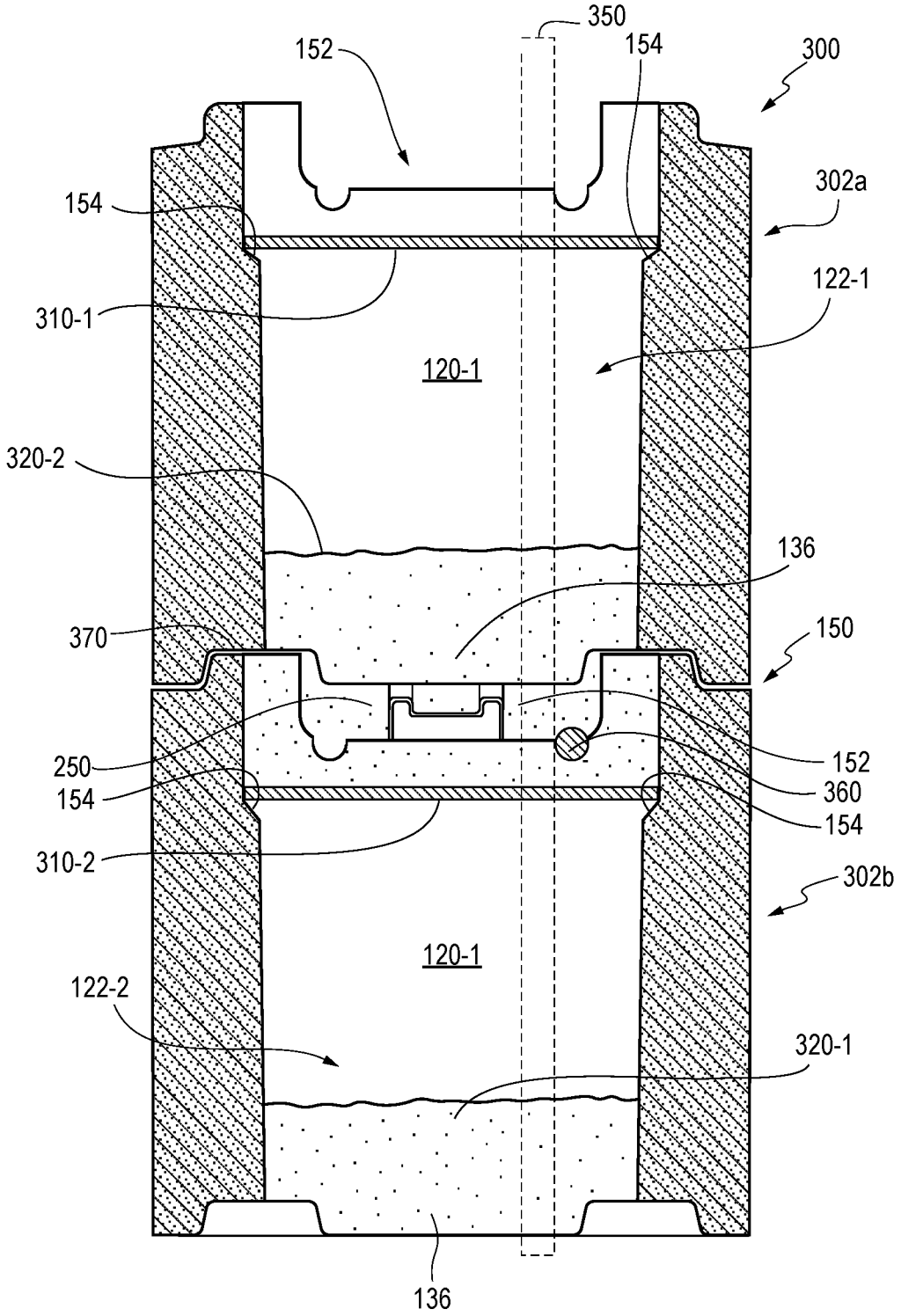
FIG. 11 is a cross-sectional elevational view of stacked blocks in a partially constructed wall taken generally along the view lined 11-11 in FIG. 10.
Figure 12:
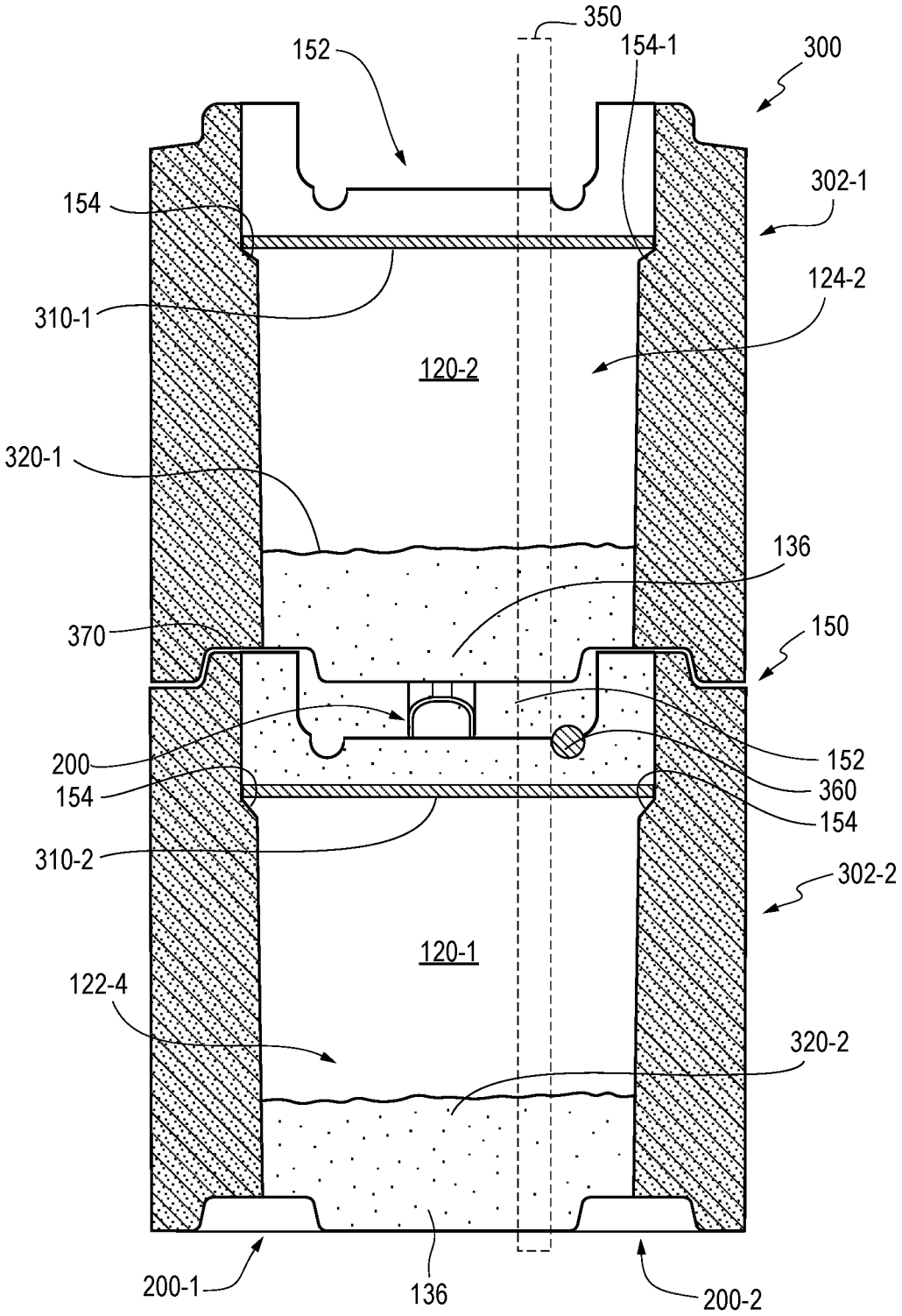
FIG. 12 is a cross-sectional elevational view of stacked blocks in a partially constructed wall taken generally along the view lined 12-12 in FIG. 10.

FIGS. 11 and 12 illustrate the condition where a first block 302-1 is stacked on a second block 302-2 after a portion of the wall has been constructed. The first block 302-1 may be the stretcher block 104 from FIG. 10. The second block 302-2 may be any of the jamb block, half jamb block, or wall stretcher block. A wide leveling shim 250 is inserted under the first web 120-1 of the first block 302-1 in the web gap between the web elevation 136 of the first block 302-1 and the gap 152 of the second block 302-2. A user may check the level of each course as the wall is constructed and leveling shims may be used any time an adjustment is needed.

Figure 13:
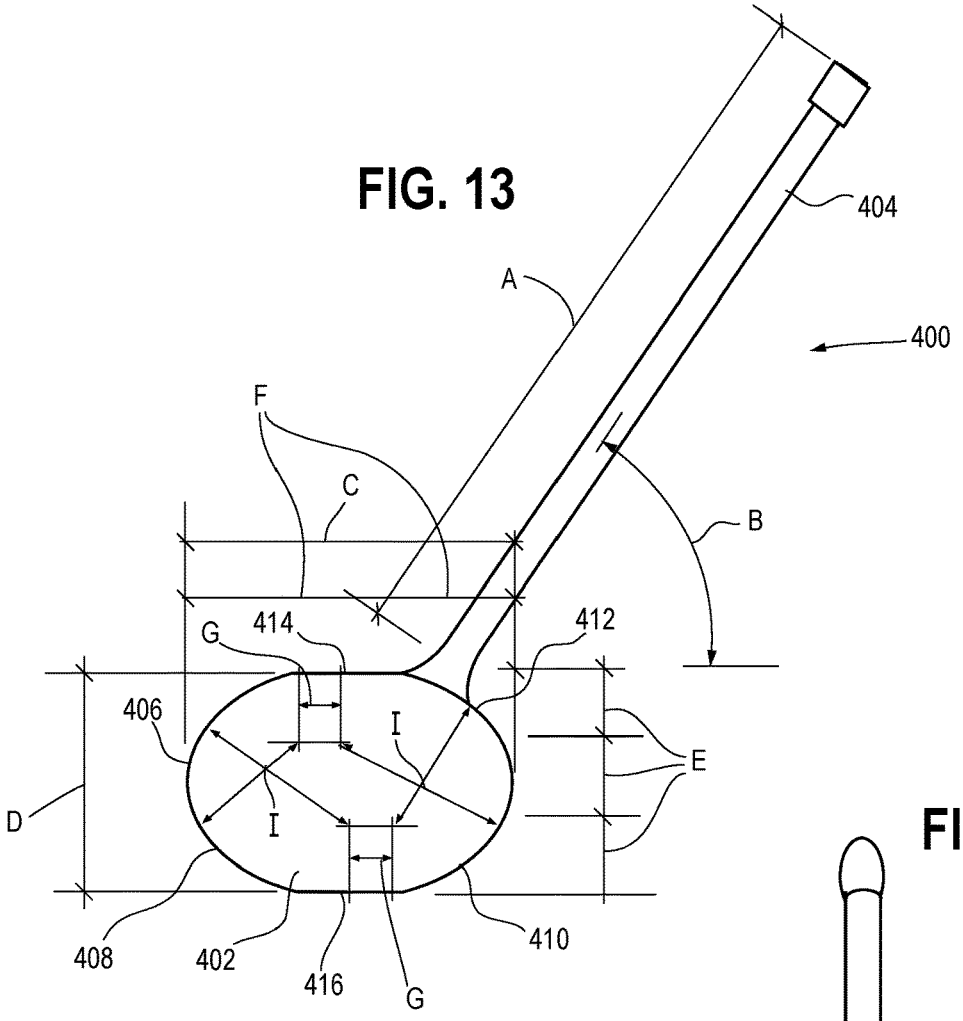
FIGS. 13 and 14 are front and side elevational views, respectively, illustrating an alternative shim.
Figure 14:
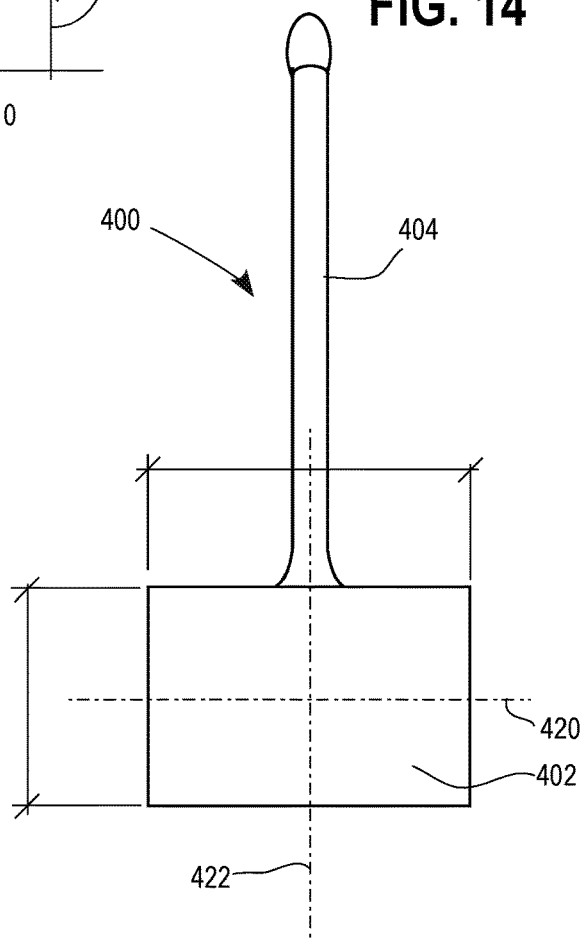

FIGS. 13-15 illustrate an alternative shim 400 having a cam shape. Specifically, the shim 400 includes a main portion 402 and an optional handle 404 joined in any suitable fashion to the main portion 402. The main portion 402 includes a plurality of surfaces that facilitate leveling of a block, for example, by insertion into the gap 152 between blocks 302-1 and 302-2 shown in FIG. 15. Specifically, the shim 400 includes four curved surfaces 406, 408, 410, and 412 and two planar surfaces 414, 416. The planar surface 414 is disposed between the pair of curved surfaces 406 and 412 and the planar surface 416 is disposed between the pair of curved surfaces 408 and 410. The curved surfaces 406, 408 are disposed adjacent one another, as are the curved surfaces 410, 412. If desired, a different arrangement of similar or different surfaces may be arranged about the main portion 402.

The shim may be made of any suitable material sufficiently stiff to be capable of supporting the weight carried thereby, such as steel, aluminum, another metal, wood, plastic, or combinations thereof. The various elements of the shim 400 preferably have the dimensions set forth below, it being understood that such dimensions are exemplary only and should not be considered to limit the scope of the claims hereof (references are to letters appearing FIG. 13 and dimensions are in inches unless otherwise specified):

| Reference | Dimension |
|---|---|
| A | 2.25 |
| B | 35 degrees |
| C | 1.00 |
| D | 0.69 |
| E | 0.23 |
| F | 0.50 |
| G | 0.125 |
| I | 0.5 |

Shims similar or identical to the shim 400 may be used exclusively to level one or more blocks of a wall. Each shim 400 may be inserted into one of the gaps 152 in the manner illustrated in FIG. 15 and as described above, using the handle 404 to facilitate insertion and positioning of the shim 400. Longitudinal depth of insertion of the shim 400 into the gap 152 and by adjusting the rotational position of the shim 400 about a longitudinal axis 420 (seen in FIG. 13). Transverse leveling along the dimension T of FIG. 10 is accomplished by adjusting the rotational position of the shim 400 about an axis 422 (also seen in FIG. 13) perpendicular to the axis 420, similar to the adjustment of the shims 200 and 250 described above. Preferably, the dimensions of the shim 400 are selected to ensure that stability of the blocks is maintained during and after leveling.

Referring to FIG. 11, the first block 302-1 is fitted with a first insert 310-1 and the second block 302-2 is fitted with a second insert 310-2. The first insert 310-1 sits on a first shelf 154-1 within the first half cell 124-1. The first half cell 124-1 forms a complete cell when another block is mounted to mate with the receiving end surface 118 (in FIG. 10). The other block includes a shelf in its half-cell to support the first insert 154-1. The second insert 310-2 sits on a second shelf 154-2 formed within a void 122-3 formed by a web 120-3 of the second block 302-2 where the first block 302-1 is mounted on the second block 302-2 in a staggered arrangement. One or more sections of horizontal rebar 360 is disposed on the web recess 152 of the second block **302*b*. One or more sections of vertical rebar 350 are inserted through the voids, cells, and half cells on the other side of the webs 120-1 and 120-3, which may be filled with a cementitious material, such as grout. A grout plug 320-1 is disposed on the second insert 310-2 in front of the web 120-1 of the first block 302-1 and web 120-3 of the second block 302-2. The grout plug 320-1 includes sufficient grout to seal a seam 370 between the blocks 302-1 and 302-2**.

FIG. 12 is a cross-sectional view 300 along section 12-12 in FIG. 10 where the block 104 of FIG. 10 is mounted on top of a second block. FIG. 12 shows a first block 302-1, which is the stretcher block 104 in FIG. 10 for purposes of this description, stacked on a second block 302-2 after a portion of the wall has been constructed. The second block 302-2 may be any of the jamb/corner block, another stretcher block, or a half jamb block as described above. A narrow leveling shim 200 or the shim 400 (in FIGS. 13 and 14) is inserted under the first web 120-1 of the first block 302-1 in the web gap between the web elevation 136 of the first block 302-1 and the gap 152 of the second block 302-2.

The first block 302-1 is fitted with a first insert 310-1 and the second block 302-2 is fitted with a second insert 310-2. The first insert 310-1 sits on a first shelf 154-1 within the first half cell 124-1. The first half cell 124-1 forms a complete cell when another block is mounted to mate with the projecting end surface 116 (in FIG. 10). The other block includes a shelf in its half-cell to support the first insert 154-1. The second insert 310-2 sits on a second shelf 154-2 formed within a void 122-3 formed by a web 120-3 of the second block 302-2 where the first block 302-1 is mounted on the second block 302-2 in a staggered arrangement. One or more sections of horizontal rebar 360 is disposed on the web recess 152 of the second block **302*b*. One or more sections of vertical rebar 350 are inserted through the voids, cells, and half cells on the other side of the webs 120-1 and 120-3, which may be filled with a cementitious material, such as grout. A grout plug 320-1 is disposed on the second insert 310-2 in front of the web 120-1 of the first block 302-1 and web 120-3 of the second block 302-2. The grout plug 320-1 includes sufficient grout to seal a seam 370 between the blocks 302-1 and 302-2**.

Another block may be stacked on the first block **302*a*** as the construction of the wall continues. As each block is added to the wall, the level of each block may be checked and adjusted if necessary using the leveling shims. Grout plugs may also be added as the wall is constructed. The blocks are stacked in a staggered arrangement using any of the block types described above to form corners and jambs, or to extend the courses to add length to the wall. Construction of the wall is made easier by the block types as no blocks need be cut in half and assembly is simplified by the structure of the blocks.

INDUSTRIAL APPLICABILITY

The wall construction system described herein advantageously allows for easy assembly of level and plumb courses of wall blocks without the need to position blocks during assembly using mortar. The resulting wall can be quickly assembled by a relatively untrained worker and is strong and attractive in appearance.

Numerous modifications to the present disclosure will be apparent to those skilled in the art in view of the foregoing description. Accordingly, this description is to be construed as illustrative only and is presented for the purpose of enabling those skilled in the art to make and use the present disclosure and to teach the best mode of carrying out same.

I claim:

1. A wall construction member, comprising:

a front surface;

a back surface;

a top side comprising a top side mating surface;

a bottom side comprising a bottom side mating surface adapted to mate with the top side mating surface;

a first end side having a planar end surface;

a second end side opposite the first end side, the second end side comprising one of a projecting end surface or a receiving end surface configured to mate with the projecting end surface;

at least one web extending between the front surface and the back surface to define at least one void; and a top surface disposed at the top side and a bottom surface disposed at the bottom side, wherein the top side mating surface comprises a multi-directional elevation pattern on the top surface adjacent the first end side;

wherein the bottom side mating surface comprises a recess pattern including a bottom perimeter surface adjacent bottom portions of the front surface, the back surface, and the first end side, at least one channel inwardly adjacent and defining at least a portion of the bottom perimeter surface and extending upwardly with respect to the bottom perimeter surface, and a web bottom surface of the at least one web disposed adjacent the at least one channel and substantially coplanar with a portion of the bottom perimeter surface;

wherein the bottom perimeter surface includes a lower surface of the first end side that extends continuously and fully from the front surface to the back surface; and wherein the recess pattern is adapted to mate with the multi-directional elevation pattern in two orientations.

2. The wall construction member of claim 1, wherein the second end side of the wall construction member is configured to mate with a stretcher block that comprises:

a stretcher front surface;

a stretcher back surface;

a stretcher top side;

a stretcher bottom side;

a first stretcher end side and a second stretcher end side opposite the first stretcher end side each having either a stretcher projecting end surface or a stretcher receiving end surface configured to mate with the projecting end surface; and a plurality of stretcher webs extending between the stretcher front surface and the stretcher back surface to define at least two stretcher voids between the first stretcher end side and the second stretcher end side, each void having a stretcher top void perimeter and a stretcher bottom void perimeter, wherein:

the stretcher top side comprises a top side stretcher mating surface comprising a unidirectional elevation pattern disposed between the first stretcher end side and the second stretcher end side, and wherein the stretcher bottom side comprises a bottom side stretcher mating surface configured to mate with the unidirectional elevation pattern.

3. The wall construction member of claim 1, wherein the top surface around the at least one void forms a rectangular area adjacent the first end side; and the multi-directional elevation pattern comprises a post-extending from each of a plurality of corners of the rectangular area around the void.

4. The wall construction member of claim 2, wherein the bottom side mating surface comprises the recess pattern extending length-wise over the bottom side and forming opposing channels adjacent the front surface and the back surface; and each web has a bottom web elevation extending to a level coplanar with at least a portion of the bottom side, wherein the bottom side mating surface has an interfitting relationship with the multi-directional elevation pattern and the unidirectional pattern.

5. The wall construction member of claim 1 wherein a top void perimeter surface comprises a rectangular area around the void; and the top side mating surface comprises a unidirectional elevation pattern adjacent the second end side configured to mate with the bottom side mating surface and the unidirectional elevation pattern comprises a first wall extending from the top void perimeter surface, wherein the first wall is higher than the front surface thereby defining a first ledge between the first wall and the front surface and a second wall opposite the first wall extends from the top void perimeter surface forming a second ledge between the second wall and the back surface.

6. The wall construction member of claim 5, wherein the at least one web includes a web recess extending across a web top surface and extending downward sufficient to define a web gap between the recessed web top surface and bottom web elevations on another block when the other block is mounted on top of the wall construction member.

7. The wall construction member of claim 6, in combination with a leveling shim comprising one of a generally wedge-like shape having a low-rise front portion and a high-rise back portion or a cam shape, wherein the leveling shim further includes a handle, wherein the leveling shim is insertable in the web gap to expand the web gap by raising the wall construction member mounted on top of the other block.

8. The wall construction member in combination with a leveling shim of claim 7, wherein the leveling shim is made of a material sufficiently stiff to support a block weight while expanding the web gap.

9. The wall construction member of claim 1, wherein when the wall construction member includes the projecting end surface on the second end side, the projecting end surface includes a first inner projecting edge extending from a first outer end shoulder disposed at an end side edge of the front surface and a second inner projecting edge extending from a second outer end shoulder formed at the end side edge of the back surface.

10. The wall construction member of claim 1, wherein when the wall construction member includes the receiving end surface on the second end side, the receiving end surface includes a first outer projecting edge extending from a first inner end shoulder and a second outer projecting edge extending from a second inner end.

11. A wall construction system, comprising:

a plurality of blocks configured to interfit in multiple courses disposed in a staggered arrangement to form walls, corners, and wall jambs, the plurality of blocks including a jamb block comprising a front surface;

a back surface;

a top side extending between the front surface and the back surface and comprising a top side mating surface;

a bottom side opposite the top side and comprising a bottom side mating surface configured to mate with a top side mating surface of another block of the plurality of blocks;

a first end side having a planar end surface; and a second end side opposite the first end side, the second end side comprising one of a projecting end surface or a receiving end surface configured to mate with a receiving end surface and a projecting end surface, respectively, of another block of the plurality of blocks;

wherein the top side mating surface comprises a multi-directional elevation pattern adjacent the first end side configured to mate with a bottom side mating surface of another block of the plurality of blocks;

wherein the bottom side mating surface includes a recess pattern comprising at least one channel inwardly adjacent and defining at least a portion of the bottom perimeter surface and extending upwardly with respect to the bottom perimeter surface wherein the bottom perimeter surface extends continuously on substantially the same plane along at least the first end side and wherein the bottom side mating surface further includes a web elevation that provides an opposing wall for the channel wherein the recess pattern is adapted to mate with the multi-directional elevation pattern in two orientations.

12. The wall construction system of claim 11, wherein the multi-directional elevation pattern comprises a post extending from each of a plurality of corners.

13. The wall construction system of claim 11, wherein the jamb block further comprises at least one web extending between the front surface and the back surface to define at least one void.

14. The wall construction system of claim 11, wherein the jamb block top side mating surface further comprises a unidirectional elevation pattern configured to mate with a bottom side mating surface of another block of the plurality of blocks.

15. The wall construction system of claim 11, wherein the jamb block comprises a first jamb block and wherein the plurality of blocks further includes a second jamb block, comprising a second jamb block front surface;

a second jamb block back surface;

a second jamb block top side extending between the second jamb block front surface and the second jamb block back surface and comprising a second jamb block top side mating surface;

a second jamb block bottom side comprising a bottom jamb block side mating surface;

a second jamb block first end side having a planar end surface;

a second jamb block second end side opposite the second jamb block first end side, the second jamb block second end side comprising one of a projecting end surface or a receiving end surface configured to mate with a receiving end surface and a projecting end surface, respectively, of another block of the plurality of blocks; and wherein the second jamb block top side mating surface comprises a unidirectional elevation pattern configured to mate with a bottom side mating surface of another block of the plurality of blocks.

16. The wall construction system of claim 11, wherein the plurality of blocks includes at least one stretcher block configured to interfit with the first jamb block and the second jamb block to form the courses stacked in a staggered arrangement, where the at least one stretcher block comprises a stretcher block front surface;

a stretcher block back surface;

a stretcher block top side extending between the stretcher block front surface and the stretcher block back surface and comprising a stretcher block top side mating surface;

a stretcher block bottom side opposite the stretcher block top side;

a first stretcher block end side; and a second stretcher block end side opposite the first stretcher block end side wherein the first stretcher block end side has a projecting end surface configured to mate with a receiving end surface of another block of the plurality of blocks and the second stretcher block end side has a receiving end surface configured to mate with a projecting end surface of another block of the plurality of blocks; and wherein the stretcher block top side mating surface comprises a unidirectional elevation pattern extending between the first stretcher block end side and the second stretcher block end side and configured to mate with a bottom side mating surface of another block of the plurality of blocks.

17. The wall construction system of claim 11, wherein a first block and a second block disposed atop the first block each including first and second webs, respectively, that vertically align when the first block and the second block are stacked in a staggered arrangement; and each web includes a web recess extending across a web top surface and extending downward sufficient to define a web gap between the web recess of the first block and bottom web elevations on the second block.

18. The wall construction system of claim 17, further including a leveling shim insertable in the web gap to expand the web gap by raising the second block.

19. A wall construction system, comprising:

a plurality of blocks each having at least one web and configured to interfit in multiple courses disposed in a staggered arrangement such that substantially all of the webs of the blocks are vertically aligned, the plurality of blocks including a first plurality of full jamb blocks, a second plurality of half jamb blocks, and a third plurality of stretcher blocks, wherein each block includes a top side mating surface and a bottom side mating surface;

wherein each block of the first plurality of full jamb blocks comprises a multi-directional elevation pattern disposed at the top side mating surface adjacent a planar first end side wherein the multi-directional elevation pattern is configured to mate with the bottom side mating surface of another block of the plurality of blocks and further comprising a second end side opposite the first end side comprising one of a projecting end surface or a receiving end surface and wherein the bottom side mating surface includes a recess pattern comprising at least one channel inwardly adjacent and defining at least a portion of the bottom perimeter surface and extending upwardly with respect to the bottom perimeter surface wherein the bottom perimeter surface extends continuously on substantially the same plane along at least the first end side and wherein the bottom side mating surface further includes a web elevation that provides an opposing wall for the channel wherein the recess pattern is adapted to mate with the multi-directional elevation pattern in two orientations;

wherein each block of the second plurality of half jamb blocks comprises a unidirectional elevation pattern disposed at the top side mating surface adjacent a planar third end side wherein the unidirectional elevation pattern is configured to mate with the bottom side mating surface of another block of the plurality of blocks and further comprising a fourth side opposite the third side comprising one of a projecting end surface or a receiving end surface; and wherein each block of the third plurality of stretcher blocks includes an elevation pattern disposed at the top side mating surface adjacent a fifth end side wherein the elevation pattern is configured to mate with the bottom side mating surface of another block of the plurality of blocks and further comprising a sixth side opposite the fifth side wherein the fifth and sixth end sides comprise a projecting end surface and a receiving end surface, respectively.

20. The wall construction system of claim 19, wherein the web elevation extends to a level substantially coplanar with the bottom perimeter surface.

21. The wall construction member of claim 1, wherein the first end side comprises a wall having an inner member that extends toward the at least one void wherein the inner member has a bottom surface substantially coplanar with the web bottom surface.

22. The wall construction member of claim 21, wherein the at least one web comprises a first plurality of spaced webs defining a second plurality of spaced voids and wherein each web comprises a bottom web elevation extending to a level substantially coplanar with the bottom surface of the inner member.

23. The wall construction system of claim 11, wherein the first end side comprises a wall having an inner member that extends toward a void wherein the inner member has a bottom surface substantially coplanar with the bottom perimeter surface.

24. The wall construction system of claim 23, wherein the jamb block includes a first plurality of spaced webs defining a second plurality of spaced voids and wherein each web comprises a bottom web elevation extending to a level substantially coplanar with the bottom surface of the inner member.

25. A wall construction member, comprising:

a front surface;

a back surface;

a top side comprising a top side mating surface;

a bottom side comprising a bottom side mating surface adapted to mate with the top side mating surface;

a first end side having a planar end surface;

a second end side opposite the first end side, the second end side comprising one of a projecting end surface or a receiving end surface configured to mate with the projecting end surface;

at least one web extending between the front surface and the back surface to define at least one void; and a top surface disposed at the top side and a bottom surface disposed at the bottom side, wherein the top side mating surface comprises a multi-directional elevation pattern on the top surface adjacent the first end side;

wherein the bottom side mating surface comprises a recess pattern including a bottom perimeter portion at a bottom of and extending fully along the front surface, the back surface, and the first end side, a bottommost surface of the bottom perimeter portion being substantially continuously coplanar along the full extent of the bottom perimeter portion;

at least one channel inwardly adjacent and defining at least a portion of the bottom perimeter and extending upwardly with respect to the bottommost surface of the bottom perimeter, and a web bottom surface of the at least one web disposed adjacent the at least one channel and substantially coplanar with the bottommost surface; and wherein the recess pattern is adapted to mate with the multi-directional elevation pattern in two orientations.

26. The wall construction member of claim 25, wherein the first end side comprises a wall having an inner member that extends toward the at least one void wherein the inner member has a bottom surface substantially coplanar with the bottommost surface.

27. The wall construction member of claim 26, wherein the at least one web comprises a first plurality of spaced webs defining a second plurality of spaced voids and wherein each web comprises a bottom web elevation extending to a level substantially coplanar with the bottommost surface.

* * * * *